US010024510B2

(12) United States Patent
Hammond et al.

(10) Patent No.: US 10,024,510 B2
(45) Date of Patent: Jul. 17, 2018

(54) FLEXIBLE LIGHT EMITTING DIODE LIGHTING PROCESS AND ASSEMBLY

(76) Inventors: Steven G. Hammond, Bemus Point, NY (US); Craig W. Hefright, Russell, PA (US)

( * ) Notice: Subject to any disclaimer, the term of this patent is extended or adjusted under 35 U.S.C. 154(b) by 0 days.

(21) Appl. No.: 12/912,718

(22) Filed: Oct. 26, 2010

(65) Prior Publication Data

US 2012/0099326 A1 Apr. 26, 2012

(51) Int. Cl.

| | |
|---|---|
| ***F21V 1/00*** | (2006.01) |
| ***F21V 11/00*** | (2015.01) |
| ***F21S 43/50*** | (2018.01) |
| ***F21S 43/19*** | (2018.01) |
| ***F21S 43/14*** | (2018.01) |
| ***F21S 43/27*** | (2018.01) |

(52) U.S. Cl.

CPC ..... *F21S 43/51* (2018.01); *F21S 43/14* (2018.01); *F21S 43/19* (2018.01); *F21S 43/27* (2018.01)

(58) Field of Classification Search

CPC .. H05K 2203/1316; F21V 31/04; F21S 43/14; F21S 43/19; F21S 43/27; F21S 43/51

USPC ..... 362/240, 249.02–249.04, 249.01, 267, 362/545–546, 549, 190, 191, 311.02; 29/841; 257/E21.502; 438/27

See application file for complete search history.

(56) References Cited

U.S. PATENT DOCUMENTS

| | | | | |
|---|---|---|---|---|
| 2,264,110 | A * | 11/1941 | Bridge | F21S 48/2212 362/333 |
| 4,160,052 | A * | 7/1979 | Krysiak | B60R 13/04 156/211 |
| 4,935,665 | A * | 6/1990 | Murata | 313/500 |
| 5,515,253 | A * | 5/1996 | Sjobom | 362/244 |
| 5,632,551 | A * | 5/1997 | Roney | B60Q 1/2696 257/E25.028 |
| 6,074,079 | A * | 6/2000 | Yanagihara | F21S 48/24 362/311.03 |
| 6,244,736 | B1 * | 6/2001 | O'Neal | F21V 15/00 362/368 |
| 6,254,262 | B1 * | 7/2001 | Crunk et al. | 362/544 |
| D446,323 | S * | 8/2001 | Hurayt | D26/28 |
| 6,299,337 | B1 | 10/2001 | Bachl et al. | |
| 6,371,637 | B1 * | 4/2002 | Atchinson et al. | 362/555 |
| 6,461,017 | B2 | 10/2002 | Selkee | |
| 6,523,986 | B1 * | 2/2003 | Hoffmann | E04F 19/02 362/153 |
| 6,717,526 | B2 * | 4/2004 | Martineau | F21V 5/04 340/815.45 |
| 6,837,726 | B1 * | 1/2005 | Kiermaier | H01R 33/0836 174/50 |
| 6,860,620 | B2 | 3/2005 | Kuan et al. | |
| 6,999,318 | B2 * | 2/2006 | Newby | F21K 9/00 257/706 |
| 7,055,987 | B2 * | 6/2006 | Staufert | 362/235 |

(Continued)

*Primary Examiner* — Tsion Tumebo

(74) *Attorney, Agent, or Firm* — The Bilicki Law Firm, PC

(57) ABSTRACT

A light emitting diode lighting assembly for mounting to a curved mounting surface, such as a vehicle surface, includes a plurality of light emitting diodes, a circuit board, and a molded polymer section for surrounding and insulating the LEDs against the circuit board. The lighting assembly also includes a lens and a flexible molded housing surrounding a perimeter of the lens and the circuit board for sealing the lens to the circuit board.

16 Claims, 12 Drawing Sheets

(56) References Cited

U.S. PATENT DOCUMENTS 7,055,996 B2 * 6/2006 Pond ..... B60Q 1/32 362/243
7,241,031 B2 * 7/2007 Sloan ..... G09F 13/0404 362/240
D561,360 S * 2/2008 Wang ..... D26/28
D573,273 S * 7/2008 Branstetter ..... D26/28
7,794,132 B2 * 9/2010 Cunius ..... F21S 4/20 174/110 R
7,923,271 B1 * 4/2011 Hwu ..... H01L 25/0753 438/26
7,942,559 B2 * 5/2011 Holder ..... F21K 9/00 362/309
7,959,322 B2 * 6/2011 Smith ..... B60Q 1/2611 362/219
7,976,194 B2 * 7/2011 Wilcox ..... F21V 5/007 362/267
8,240,888 B2 * 8/2012 Zhang ..... F21V 5/04 362/311.02
8,251,543 B2 * 8/2012 Bauer ..... F21S 8/037 248/220.1
8,737,073 B2 * 5/2014 Yeh ..... H05K 1/0203 174/260
8,757,831 B2 * 6/2014 Waters ..... A42B 1/244 200/566
2002/0016562 A1 * 2/2002 Cormier ..... A61B 5/15142 604/20
2002/0044454 A1 * 4/2002 Roller ..... B60Q 1/32 362/540
2004/0032638 A1 * 2/2004 Tonar et al. ..... 359/265
2004/0184276 A1 * 9/2004 Moll ..... B60Q 1/32 362/487
2005/0152142 A1 * 7/2005 Traynor ..... A01K 11/00 362/249.01
2005/0201091 A1 * 9/2005 Kramer et al. ..... 362/249
2006/0293435 A1 * 12/2006 Marens et al. ..... 524/497
2008/0054288 A1 * 3/2008 Harrah et al. ..... 257/99
2009/0090342 A1 * 4/2009 Freitag et al. ..... 124/35.2
2009/0154182 A1 * 6/2009 Veenstra ..... B60Q 1/2696 362/487
2010/0008090 A1 * 1/2010 Li ..... F21V 17/007 362/249.03
2010/0014281 A1 * 1/2010 Kim ..... H01L 33/54 362/97.2
2010/0020541 A1 * 1/2010 Incorvia ..... F21V 31/04 362/249.01
2010/0271818 A1 * 10/2010 Smith ..... B60Q 1/2611 362/235
2011/0095690 A1 * 4/2011 Sagal ..... B29C 45/14 315/113

* cited by examiner

FLEXIBLE LIGHT EMITTING DIODE LIGHTING PROCESS AND ASSEMBLY

SUMMARY

A light emitting diode lighting assembly for mounting to a curved mounting surface, such as a vehicle surface, is disclosed. The lighting assembly includes a plurality of light emitting diodes (LEDs), a circuit board for providing electrical current to the LEDs. The circuit board may also have a resistor electrically connected thereto. A molded polymer section is molded around the LEDs and resistor, thereby surrounding and insulating such electrical components against the circuit board.

The circuit board and molded polymer section are adapted to fit within a cavity of a lens having optical surfaces. The lens is positioned such that an air gap is present between the top surfaces of the LEDs and the lens. The lighting assembly also includes a flexible molded housing surrounding a perimeter of the lens and the circuit board for sealing the lens to the circuit board. The flexible molded housing is molded while maintaining the air gap between the top surfaces of the LEDs and the lens.

The lighting assembly also includes an adhesive material positioned against a back portion of the flexible molded housing for attaching the lighting assembly to a surface without the use of fasteners.

DETAILED DESCRIPTION OF THE EMBODIMENTS

Figure 1:
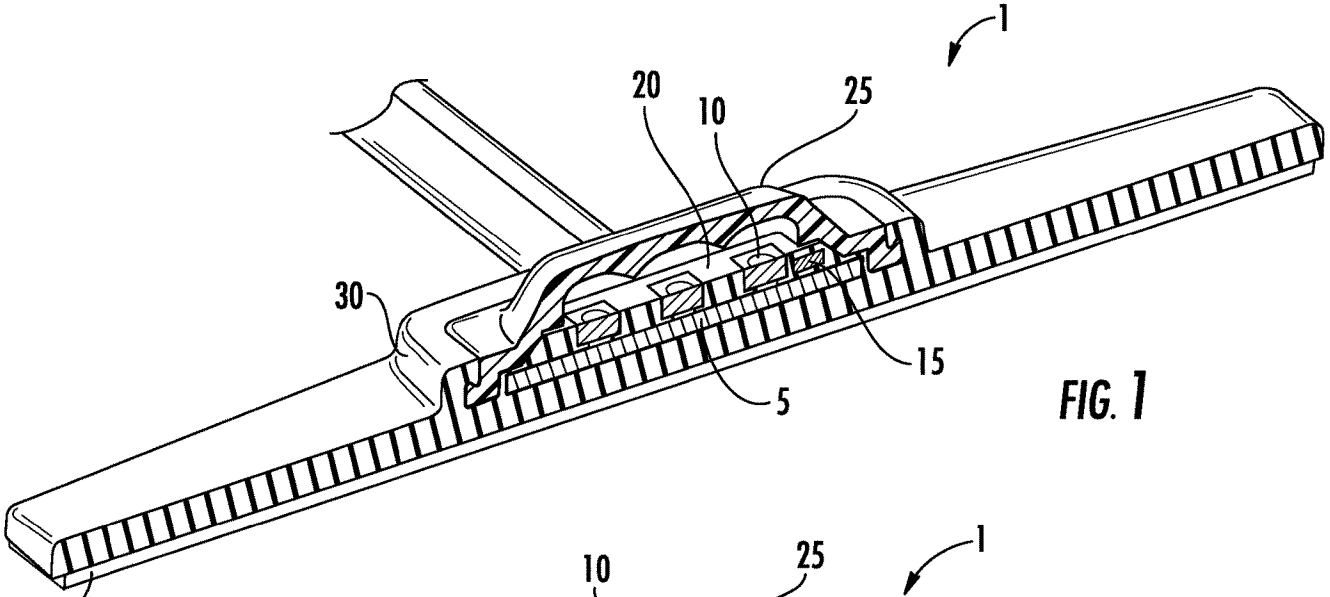
FIG. 1 is a perspective view of one embodiment of the Flexible Light Emitting Diode Lighting Assembly.
Figure 2:
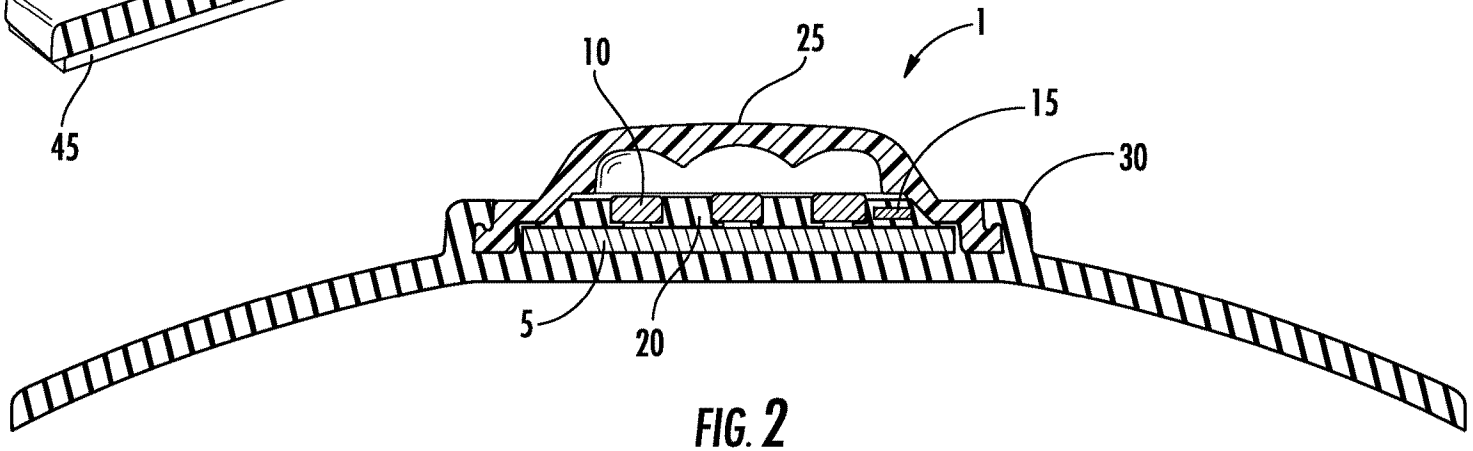
FIG. 2 is a side view of the embodiment of FIG. 1.

As illustrated in FIGS. 1 and 2, a first embodiment of a flexible light emitting diode lighting assembly 1, hereinafter "lighting assembly 1," includes a circuit board 5 having a plurality of light emitting diodes, one of which is indicated at 10, affixed thereto. Circuit board 5 also includes an electrically connected resistor 15. A first molded portion 20 surrounds the light emitting diodes 10 and resistor, thereby sealing such components to circuit board 5. A lens 25 is positioned over circuit board 5 such that lens 25 covers first molded portion 20 and circuit board 5. A flexible molded housing 30 surrounds a lower portion of lens 25 to seal circuit board 5 and prevent moisture from entering between lens 25 and flexible molded housing 30. In the embodiment shown in FIGS. 2 and 3, housing 30 includes extension wings 40, which extend laterally from said circuit board and allow lighting assembly 1 to be mounted to a curved surface.

Figure 3:
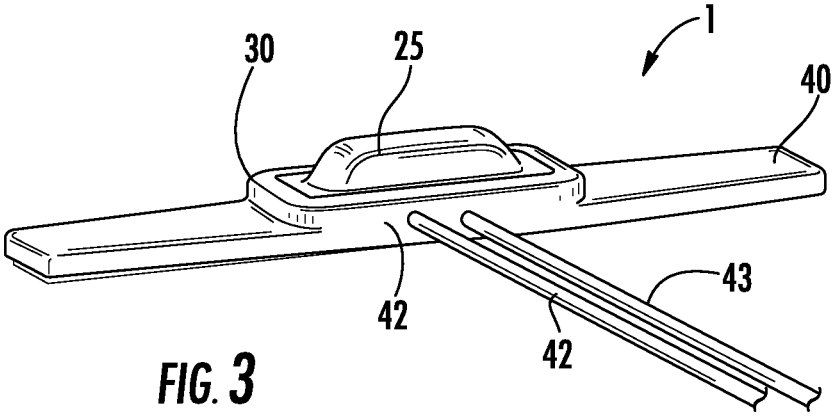
FIG. 3 is a back perspective view of the Flexible Light Emitting Diode Lighting Assembly.
Figure 4:
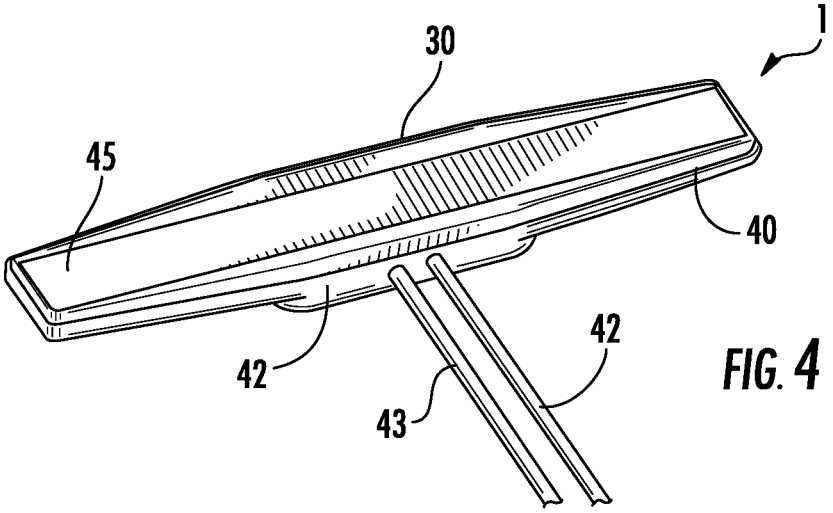
FIG. 4 is a bottom view of the Flexible Light Emitting Diode Lighting Assembly.
Figure 5:
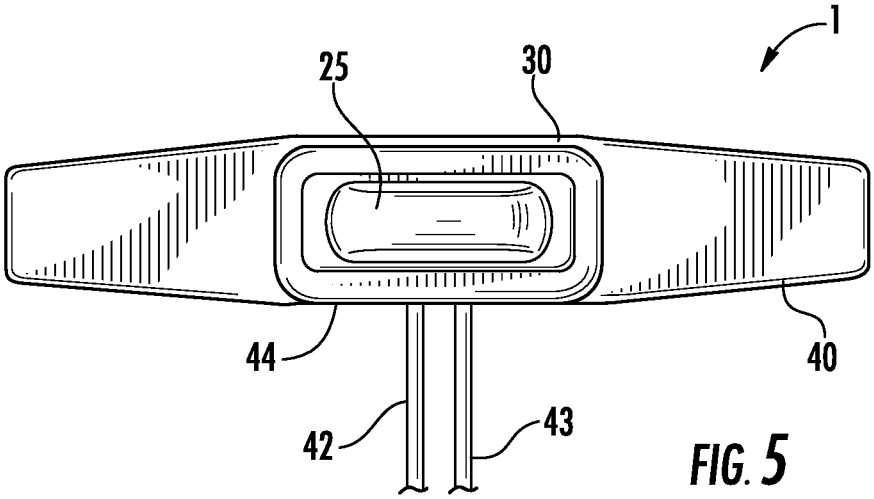
FIG. 5 is a top view of the Flexible Light Emitting Diode Lighting Assembly.
Figure 6:
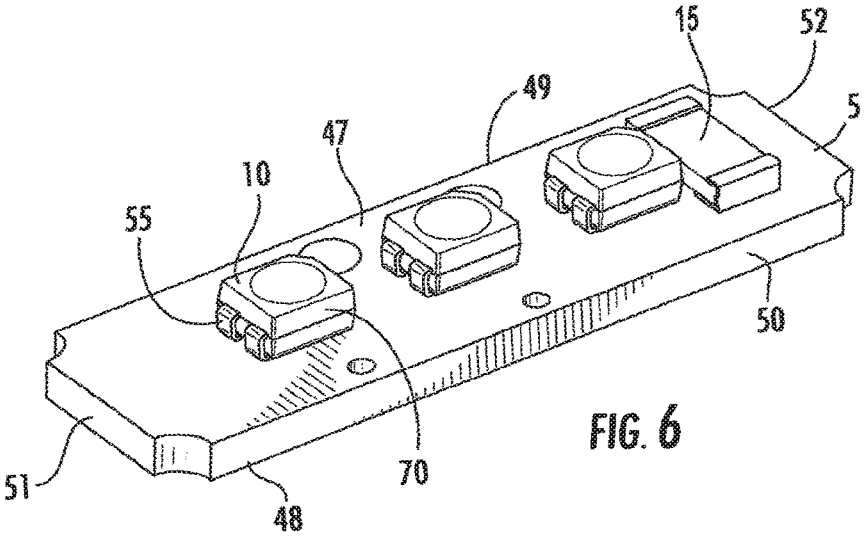
FIG. 6 is a top view of a circuit board having a plurality of Light Emitting Diodes connected thereto.

FIGS. 3-5 illustrate a side perspective view, bottom perspective view, and top view of lighting assembly 1, respectively, with wires 42, 43 extending from a side edge 44 of flexible molded housing 30. Wires 42, 43 are used to attach lighting assembly 1 to a vehicle wiring harness (not shown). Wires 42, 43 may exit side edge 44 of lamp assembly as shown in FIGS. 3-5, for vehicles where harnesses are run on an exterior of a vehicle. Alternatively, wires 42, 43 may exit a bottom surface of lamp assembly 1 to conceal the wires, as will be described in detail with reference to FIGS. 11-14.

As shown in FIG. 4, lighting assembly 1 includes an adhesive material, such as tape, 45 affixed to a bottom portion of flexible molded housing 30 for attaching lighting assembly to a mounting surface (not shown) in a manner that does not require fasteners that damage the mounting surface. Extension wings 40 of flexible molded housing, along with adhesive material 45 facilitate the attachment of lighting assembly 1 to a curved surface without the use of additional fasteners or tools.

Each component of lighting assembly 1 will now be described in greater detail with reference to FIGS. 6-9. Initially, with reference to FIG. 6, circuit board 5 includes a top surface 47, a bottom surface 48, a pair of side edges 49, 50 and ends 51, 52. Circuit board 5 provides electrical current to LEDs 10 via electrical connection 55. LEDs 10 are positioned on top surface of circuit board 5. Resistor 15 is also provided on circuit board 5 for controlling the electrical current supplied by wires 42, 43 and circuit board 5 to LEDs 10. Circuit board 5 also acts as a heat sink for drawing heat away from LEDs 10. In the embodiment shown, circuit board 5 is not flexible. However, in other embodiments circuit board 5 may be flexible. Circuit board 5 is not flexible since, in the embodiment shown, it is desirable for LEDs 10 to have the same planar relationship relative to one another. By maintaining LEDs 10 in the same plane, the photometric output of lighting assembly 1 is not altered.

LEDs 10 may be selected to meet photometric requirements of a variety of vehicle lighting applications, such as Clearance lamp, Side Marker lamp, or Identification Lamp, or Combination Clearance and Side Marker lamp as set forth by the SAE guidelines. We hereby incorporate by reference SAE J592e, July 1972, which describes photometric requirements of several lighting applications. In the embodiment shown in FIG. 6, LEDs 10 have a flat top face (not separately numbered) surrounded by LED potting compound. LEDs have a height 70, which indicates the distance from top surface 47 of circuit board 5 to flat top surface of LEDs 5. However, it should be understood that other types of LEDs may be used. In addition, LEDs 10 may be selected to emit a variety of different colored light, such as white, red or amber.

Figure 7:
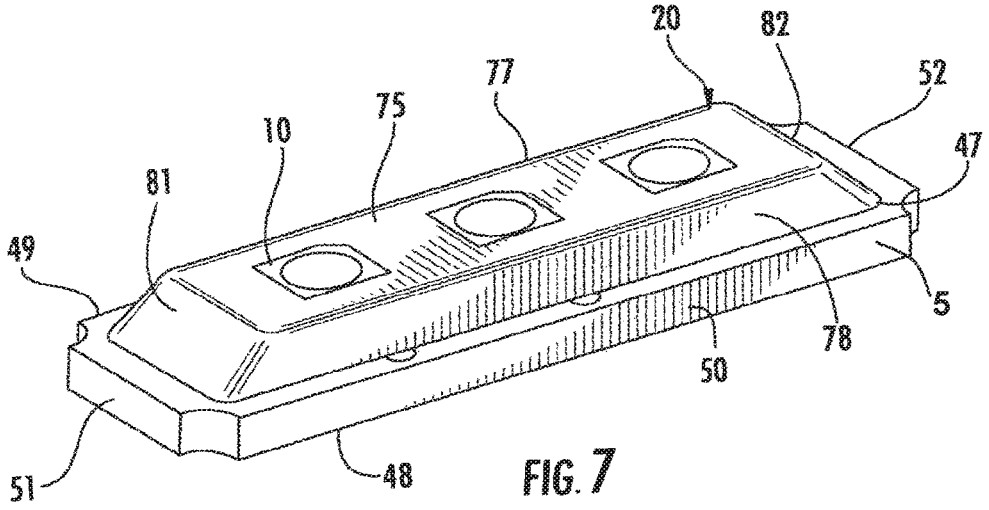
FIG. 7 is a top view of the circuit board of FIG. 10 further including a first molded material.

FIG. 7 illustrates molded portion 20 molded to top surface 47 of circuit board 5. Molded portion 20 adheres to circuit board 5 and surrounds LEDs 10, covering and protecting electrical connections 55. Resistor 15 is also fully surrounded and covered by molded portion 20. Molded portion 20 includes a top face 75, sides 77, 78 and sloped ends 81, 82. A polymer material such as a polyamide hot melt adhesive is used to form molded portion 20.

Figure 8:
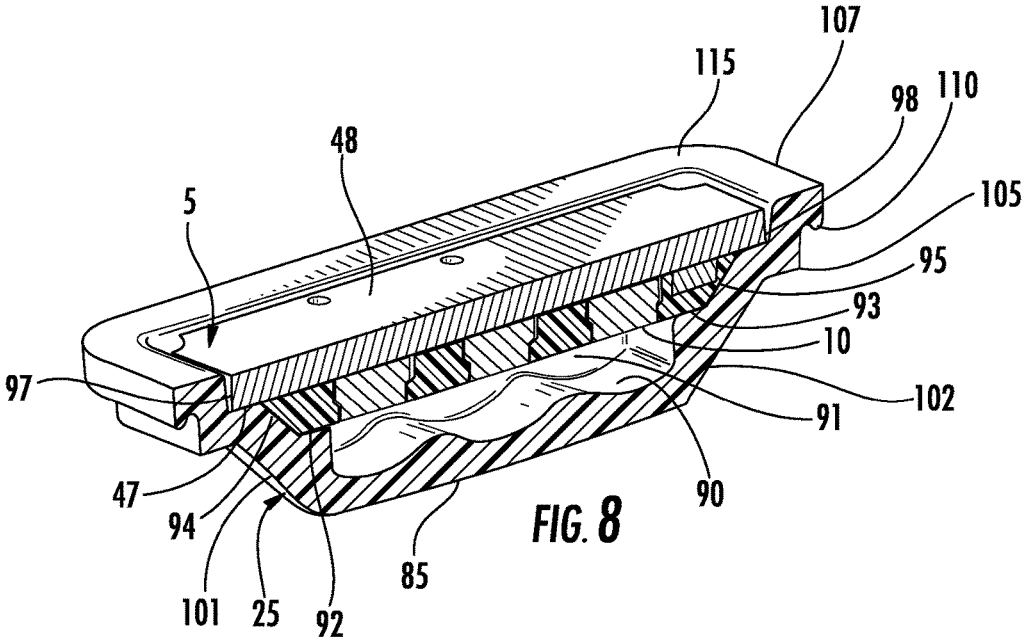
FIG. 8 is a bottom perspective view of the assembly as shown in FIG. 7, further including a lens.

Lens 25, as illustrated in FIG. 8, is formed from an injection molded acrylic or polycarbonate plastic material and includes optical surfaces to disperse light emitted from LED's 10 to meet photometric requirements for the intended use of lighting assembly 1. Lens 25 includes an outer surface 85 and an inner surface having optical elements 90 (such as pillow optics) that are aligned with LEDs 10 for transmitting light. Outer surface 85 may be curved having differing radii each direction. In addition, outer surface 85 may include a protruding optical element 290 in the center of outer surface 85 of lens 25 to direct light to extreme angles (e.g. 85 to 90 degrees to face of lighting assembly 1). Protruding optical element 290 will be described with reference to FIGS. 17-26 below. An air gap 91 is maintained between the top surface of LEDs 10 and the inner surface optical elements 90 of lens 25. Inner surface of lens 25 also includes first interior abutment portions 92, 93 and interior slanted portions 94, 95 for abutting top surface 75 and sloped ends 81, 82 of molded portion 20. Lens 25 also includes second interior abutment portions 97, 98 for contacting a portion of top surface 47 of circuit board 5.

As shown in FIG. 8, lens 25 also includes outer slanted edges 101 and 102 extending downward from outer surface 85. Slanted edges 101 and 102 terminate at a first circumferential ledge 105. A second, stepped circumferential portion 107 includes an upward extending, terminal lip 110 for engaging flexible housing 30 and a bottom circumferential surface 115, which is in substantially the same plane as bottom surface 48 of circuit board 5. In addition, lens 25 may be formed from a clear, anther, red or other color material.

Figure 9:
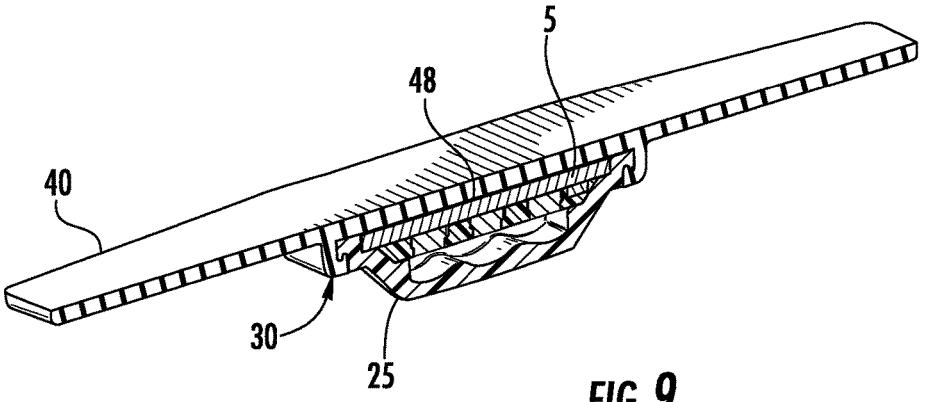
FIG. 9 is a bottom perspective view of one embodiment of a Light Emitting Diode Assembly.

As illustrated in FIG. 9, flexible molded housing 30 surrounds circuit board 5 and lens 25 such that housing 30 seals circuit board 5 and lens 25. Molded housing contacts bottom surface 48 of circuit board 5. Lens 25 is sealed by molded housing 30 at first circumferential ledge 105 and second circumferential portion 107. In addition, molded housing 30 surrounds upward extending lip 110 of second circumferential portion 107 to further secure the seal between lens 25, circuit board 5, and housing 30. Housing is formed from a polymer material, such as a polyamide hot melt adhesive. As shown in FIG. 9, housing 30 may include extension wings 40 for facilitating the mounting of lighting assembly 1 on a curved surface. Thus, flexible housing 30 is used to conform to a vehicle surface, as well as seal the electrical components and lens cavity, preventing moisture ingress.

Figure 10:
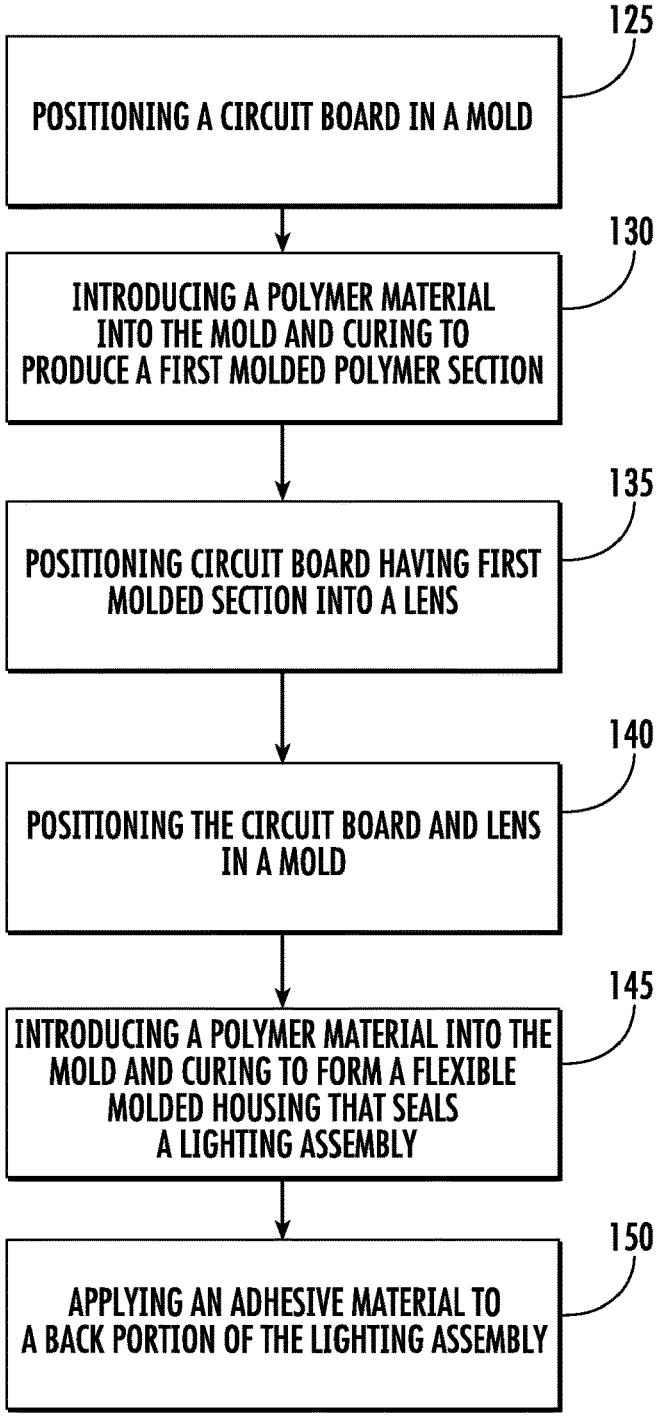
FIG. 10 is a process flow chart of the process of manufacturing a Light Emitting Diode Lighting Assembly.

FIG. 10 illustrates the process of manufacturing an embodiment of lighting assembly 1. As indicated by numbers 125 and 130, circuit board 5 having LEDs 10 and resistor 15 are initially positioned into a mold. A thermoplastic polymer material is injected into the mold under low pressure such that it surrounds LEDs 10 and resistor 15. The molding tool includes spring loaded shut-off pins, as are known in the art. The shut off pins are required to shut off on the faces of LED's 10 during molding to prevent the faces of LEDs 10 from being covered during molding. The spring loaded shut off pins must have a large enough diameter pin to allow for LED alignment tolerances from assembly of circuit board 5, and (B) tolerances for inserting circuit board 5 into the molding tool.

The diameter of the spring loaded pins should not be so large such that the diameter extends beyond LEDs 10, since there is a change that the pin will be pushed back by injection pressure. In addition, the spring pressure must be light enough not to damage LEDs 10 or a solder joint, yet be strong enough to resist push back from injection pressure. Further, the travel of the shut-off pins, and level of travel in comparison to the material surrounding the LED's, must be enough to allow for the stack-up tolerances of circuit board 5 and LEDs 10, but can not be too deep or it will block light emitted from LEDs 10 at extreme angles.

Thus, the thermoplastic polymer material, such as polyamide, is injected into a molding tool capable of preventing the top surfaces of LEDs 10 from being covered by polymer during molding. Circuit board 5, lens 25 and polymer material are left in the mold to cure. When the polymer material is cured, the resulting part includes a first molded portion 20 surrounding and insulating LEDs 10, electrical contacts 55, and resistor 15 against top surface 47 of circuit board 5.

As indicated by 135 in FIG. 10, circuit board 5 with molded portion 20 is positioned within a cavity of lens 25. Lens 25 is formed from an injected molded acrylic or polycarbonate plastic material. Lens 25 includes optical elements 90 to disperse light emitted from LEDs 10 to meet requirements of the intended use for lighting assembly 1. Lens 25 includes structural features to assist in aligning circuit board 5 and first molded portion 20 within lens cavity. For example, first interior abutment portions 92, 93, interior slanted portions 94, 95, second interior abutment portions 97, 98 of lens 25 act as alignment features for circuit board 5 and molded portion 20. Correct alignment of circuit board 5, molded portion 20 and LEDs 10 is necessary such that air gap 91, between the inner surface of lens 25 and top surface of LEDs 10 is maintained to allow light to propagate through lens optical elements 90 at intended angles to meet photometry requirements.

As noted in FIG. 10, steps 140 and 125, circuit board 5 and lens 25 are positioned into a mold and a thermoplastic polymer, such as a polyamide hot melt adhesive material, is introduced into the mold such that it seals lens 25 and circuit board 5, while maintaining air gap 91. The polymer material surrounds first circumferential ledge 105, second circumferential portion 107 and upward extending lip 110 of lens 25 to assist in sealing lens 25 and circuit board 5. Bottom surface 48 of circuit board 5 is also sealed with the polymer material. The polymer material is then cured to form flexible molded housing 30. The mold may allow for the formation of extension wings 40, which are integrally formed with molded housing 30 with thermoplastic polymer in the molding process. Extension wings 40 allow lighting assembly 1 to be mounted to a flat, irregular, or curved surface down to a minimum 4.5" radius.

Step 150 of the embodiment illustrated in FIG. 10 is directed to applying an adhesive material 45 against a back portion of molded housing 30 lighting assembly 1. In the embodiment disclose, adhesive material 45 is a double sided foam tape. However, the adhesive material may be any suitable material known in the art. Lamp is mounted with a double sided foam tape, eliminating the need for mounting hardware or special brackets.

Figure 11:
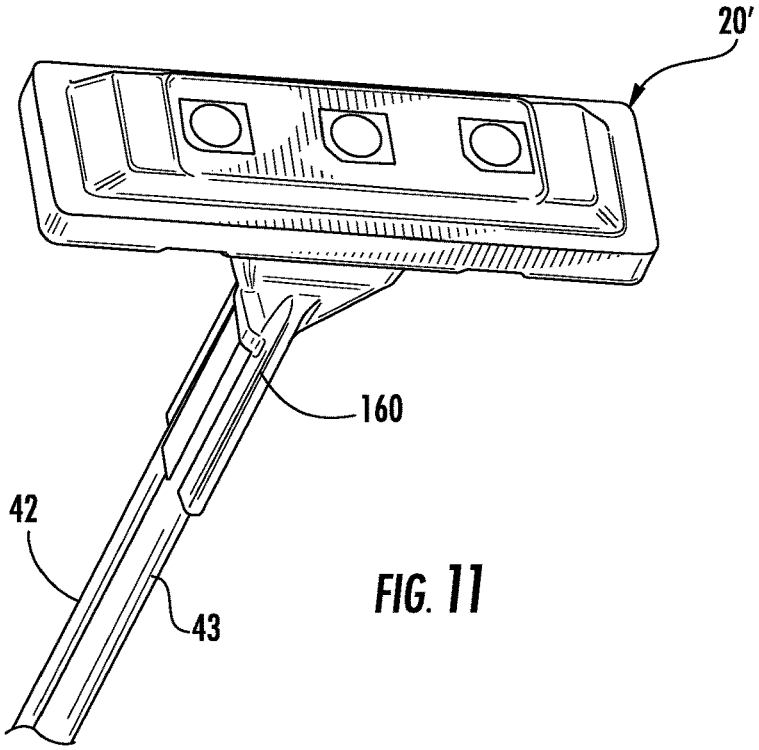
FIG. 11 is a top view of another embodiment of a partially formed Flexible Light Emitting Diode Lighting Assembly.
Figure 12:
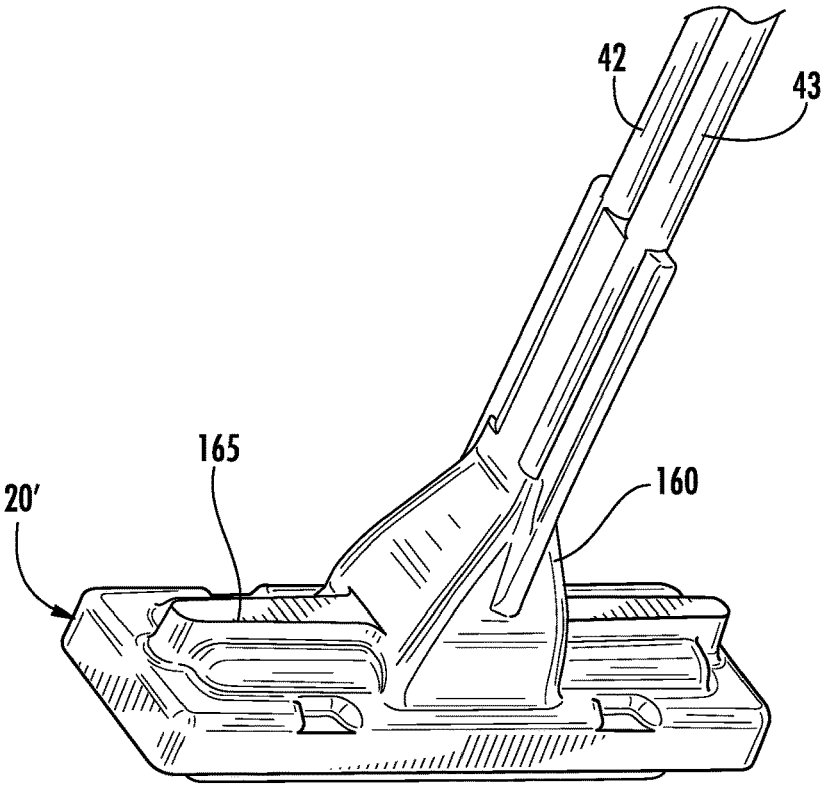
FIG. 12 is a bottom view of the partially formed Flexible Light Emitting Diode Lighting Assembly of FIG. 11.

FIGS. 11-14 illustrate an alternate embodiment of lighting assembly 1'. As shown in FIGS. 11-12, wires 42, 43 exit from bottom surface 48 of circuit board 5. First molded portion 20' surrounds circuit board 5 to seal LEDs 10, resistor 15 and any other electrical components. In addition, first molded portion 20' extends to bottom portion 48 of circuit board 5 and includes an encasing portion 160 to contain wires 42, 43 extending from circuit board 5. Molded portion 20' also includes a raised ridge 165 formed on bottom surface 48 of circuit board 5. Encasing portion 160, which is integrally formed with raised ridge 165, prevents wires 42, 43 from being exposing the wires during subsequent molding processes.

Figure 13:
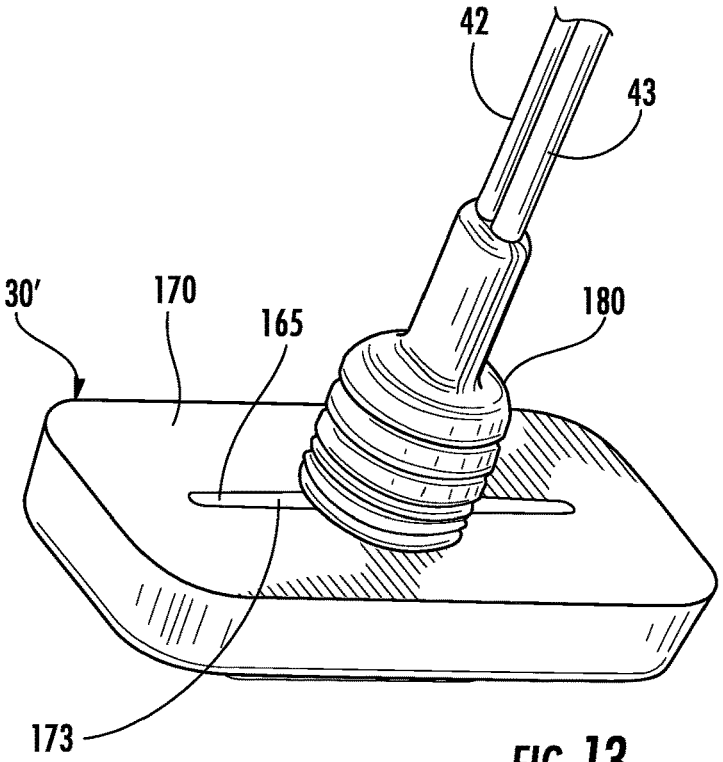
FIG. 13 is a bottom view of another embodiment of a fully formed Flexible Light Emitting Diode Lighting Assembly.
Figure 14:
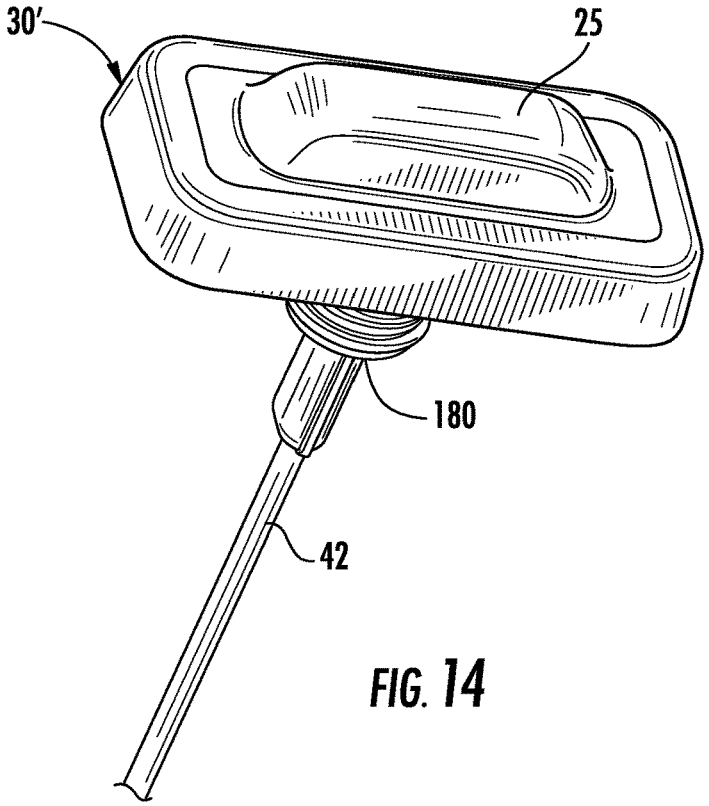
FIG. 14 is a top view of another embodiment of a fully formed Flexible Light Emitting Diode Lighting Assembly.

Following molding and curing of first molded portion 20', lens 25 is positioned for molding. Flexible housing 30' is molded around first molded portion 20' and lens 25. Flexible housing 30' surrounds lens and first molded portion 20' such that moisture egress is prevented. Flexible housing 30' includes a substantially flat bottom 170 having a slit opening 173 through which raised ridge 165 extends to further secure flexible housing 30' to molded portion 20'. A plug 180 is also molded into flexible housing for covering encasing portion 160 of molded portion 20'. With the embodiment shown in FIGS. 11-14, a hole in the mounting surface is required to conceal wires, 42, 43, encasing 160 and plug 180. As shown in FIG. 13, plug 180 also includes circumferential grooves (not separately labeled) formed therein. Plug 180 is molded such that it can fill a standard hole in a vehicle or other mounting surface. The polymeric material of encasing 160 and plug 180 also create a strain relief for wires 42, 43.

Figure 15:
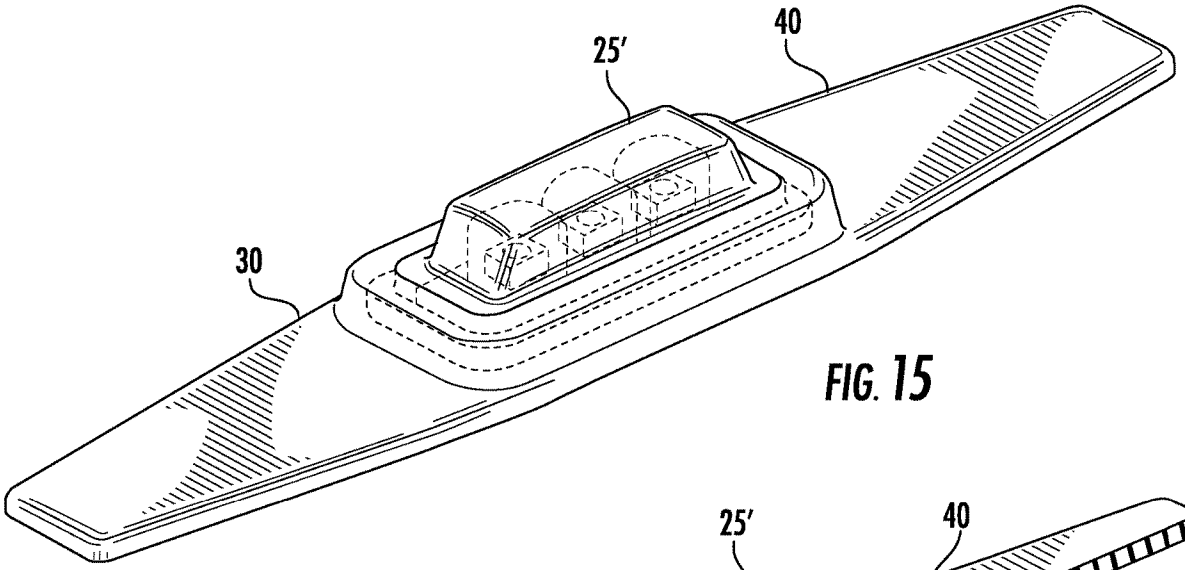
FIG. 15 is a top perspective view of another embodiment of a Light Emitting Diode Lighting Assembly.
Figure 16:
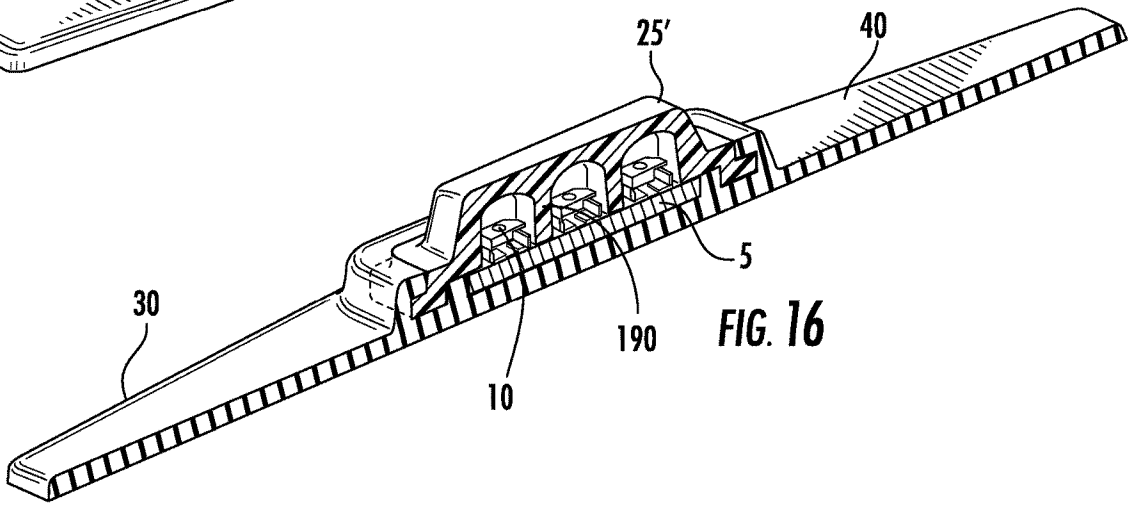
FIG. 16 is a side cross-sectional view of another embodiment of a Light Emitting Diode Lighting Assembly.

In yet another embodiment, as illustrated in FIGS. 15 and 16, lighting assembly does not include a first molded portion 20. In this embodiment, lighting assembly 1 includes LEDs 10, a circuit board 5, a lens 25' and a flexible housing 30. Lens 25' is configured to receive circuit board 5 with LEDs 10 with out requiring first molded portion 20 for positioning guidance. Lens 25' includes extensions 190 positioned along an inner surface of lens 25', dividing each optical element 90. Extensions abut top surface 47 of circuit board 5 to assist in aligning LEDs 10 with optical elements 90. Extension wings 40 are provided on flexible housing 30 to allow lighting assembly 1 to be fixed by adhesive to a flat or curved surface.

Figure 17:
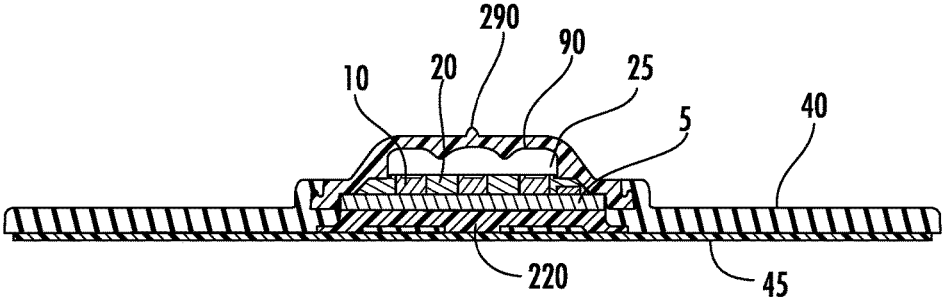
FIG. 17 is a perspective, cross-sectional view of an additional embodiment of the Flexible Light Emitting Diode Lighting Assembly.
Figure 18:
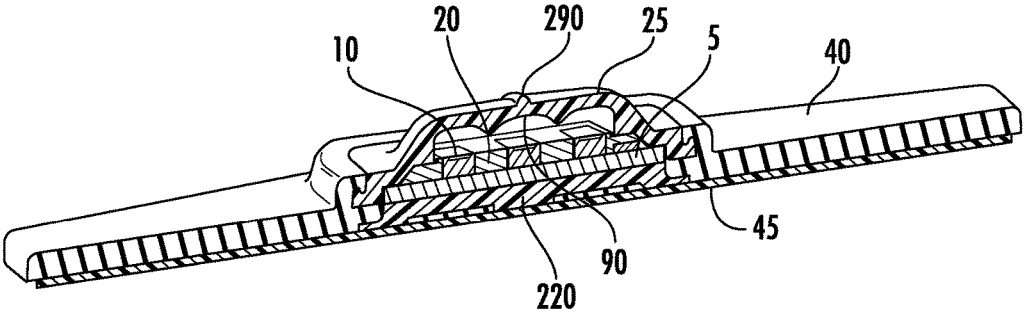
FIG. 18 is a side, cross-sectional view of the additional embodiment of the Flexible Light Emitting Diode Lighting Assembly of FIG. 17.
Figure 19:
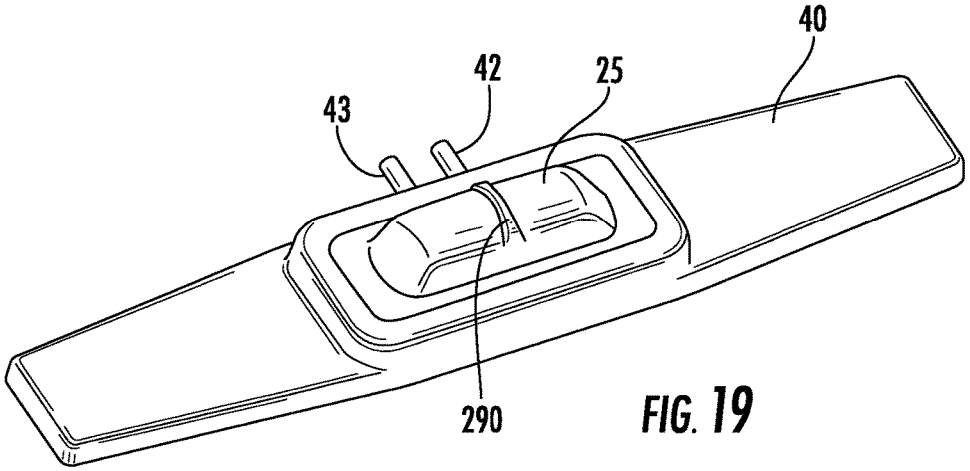
FIGS. 19-21 are top perspective, top and side views of one embodiment of the Flexible Light Emitting Diode Lighting Assembly.

FIGS. 17-21 illustrate an additional embodiment of Flexible Light Emitting Diode Lighting Assembly 1. With reference to FIGS. 17 and 18, a bottom molded portion 220 is present on a bottom surface 48 of circuit board 5. Bottom molded portion 220 is molded during step 130 of FIG. 10 and is formed of the same polymer material as molded portion 20. The sealing of circuit board 5 and LEDs 10 is enhanced by bottom molded portion 220. An adhesive material 45, as described in connection with previous embodiments, is applied to the underside of bottom molded portion 220.

Figure 20:
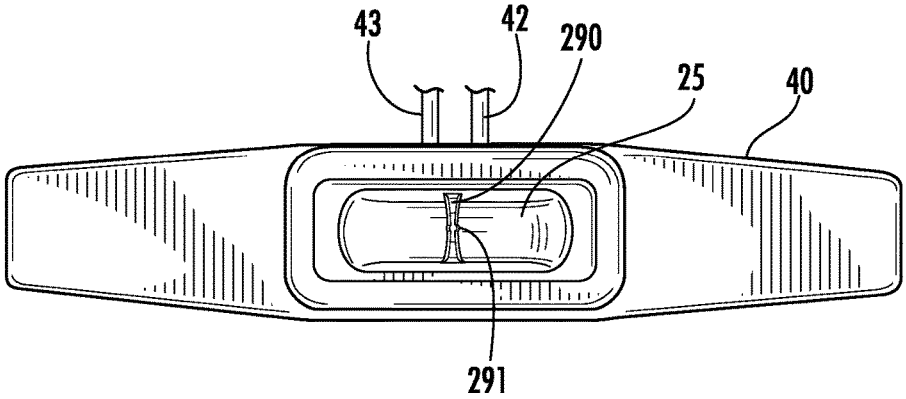
Figure 21:
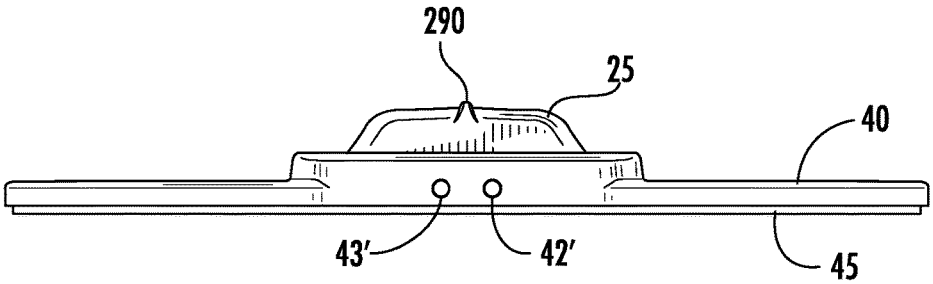
Figure 22:
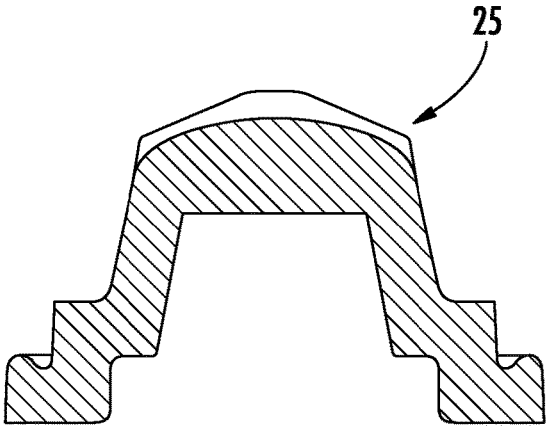
FIG. 22 is a side cross-sectional view of the lens of the Flexible Light Emitting Diode Lighting Assembly.
Figure 23:
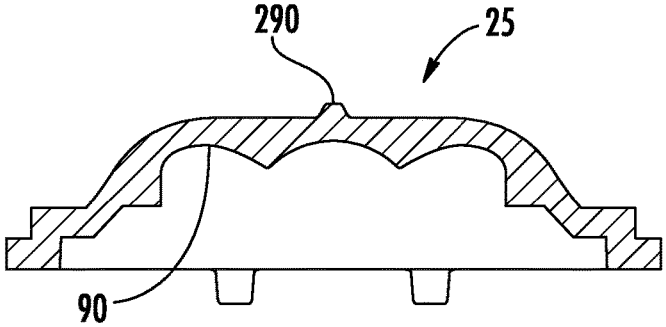
FIG. 23 is another cross-sectional view of the lens of the Flexible Light Emitting Diode Lighting Assembly.
Figure 24:
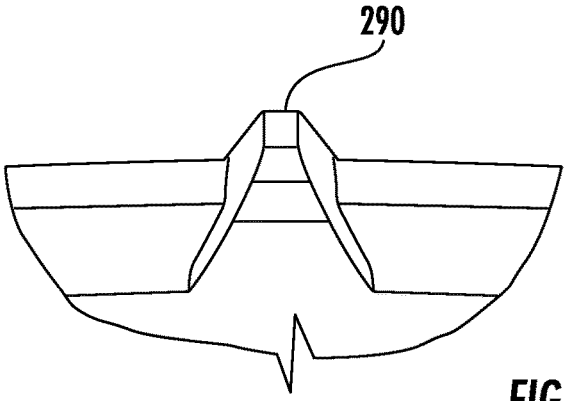
FIG. 24 is an enlarged view of an optical element of the Flexible Light Emitting Diode Lighting Assembly of FIG. 23.
Figure 25:
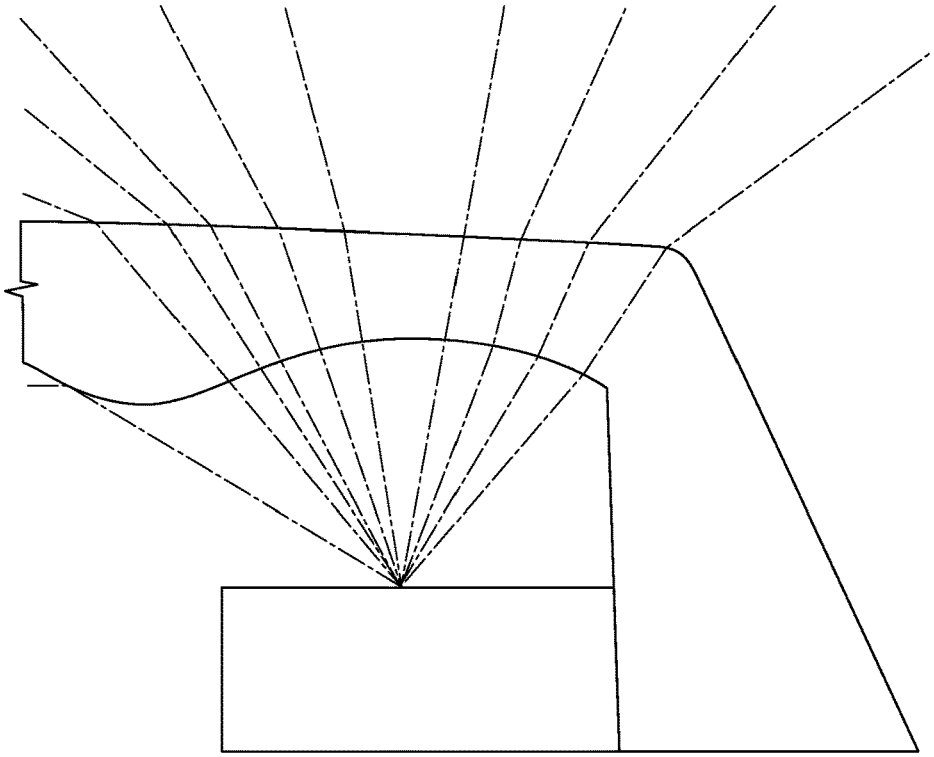
FIGS. 25 and 26 illustrate beam patterns created by internal optical elements and external optical elements, respectively.

FIGS. 17-25 illustrate lighting assembly 1 having lens 25 with an outer surface 85 that is curved having differing radii each direction. In addition, outer surface 85 includes a protruding optical element 290 to direct light to extreme angles (e.g. 85 to 90 degrees to face of lighting assembly 1). FIG. 24 is an enlarged view of protruding optical element 290 showing flat edges (not labeled) for use in creating a light ray pattern. As best shown in FIG. 20, lens 25 includes a raised ridge 291 that bisects lens 25 along protruding optical element 290. Raised ridge 291 also contributes to the distribution of light rays from LEDs 10.

Figure 26:
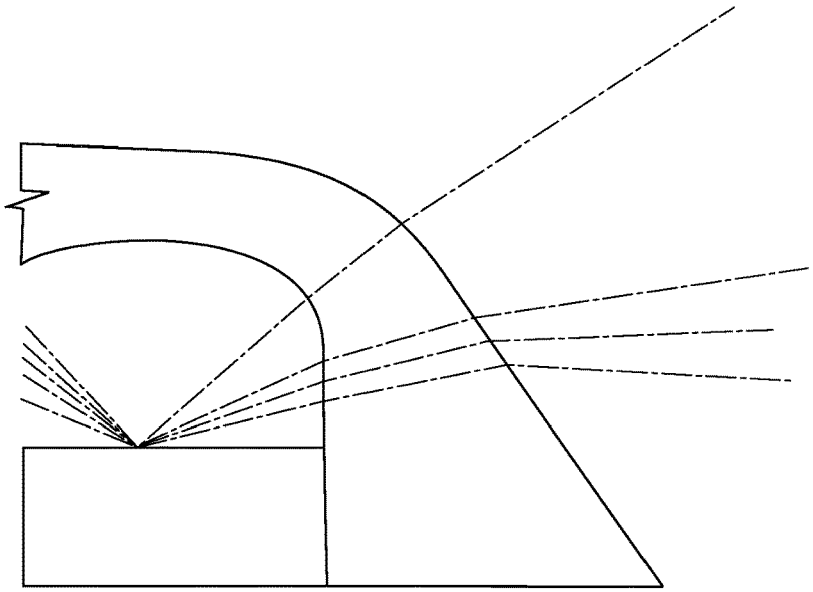

Inner optical surfaces 90 of lens 25, which are centered above each LED 10 produces a 0-56 degree light ray pattern. One internal optical surface 90 is illustrated above one LED 10 to illustrate the 0-56 degree light ray pattern in FIG. 25. Similar optical elements are positioned above the additional LEDs 10 in lighting assembly 1. Outer optical elements of lens 25, including protruding optical element 290 with raised ridge 291, and internal optical elements at the end of the lens (not separately labeled), work in conjunction to direct light out to the sides of the lamp (56-100 degrees) to meet industry requirements at extreme angles. FIG. 26 illustrates the 56-100 degree light ray pattern created by lens 25 over one of LEDs 10.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A light emitting diode lighting assembly mountable to a curved surface comprising:

at least one light emitting diode;

a circuit board for providing electrical current to said at least one light emitting diode;

a molded polymer section surrounding and insulating said at least one light emitting diode against said circuit board, wherein said molded polymer section is polyamide;

a lens having an inner surface, an outer surface, a perimeter defined by a circumferential ledge, and a lens cavity formed therein, said lens being positioned over said molded polymer section and circuit board such that an air gap is present between a top surface of said at least one light emitting diode and said inner surface of the lens;

a flexible molded housing surrounding the perimeter of said lens and said circuit board thereby sealing said lens and said circuit board, while maintaining the air gap between said top surface of said at least one light emitting diode and the inner surface of said lens, wherein said flexible molded housing is polyamide;

an adhesive material positioned against a back portion of said flexible molded housing for attaching said light emitting diode lighting assembly to said curved surface;

and wherein the flexible molded housing includes a pair of flexible extension wings elastically deformable up to a radius of curvature of 4.5 inches for curving such that said light emitting diode lighting assembly may be adhesively attached to said curved surface.

2. The light emitting diode lighting assembly of claim 1 further comprising a second molded polymer section for sealing a bottom surface of said circuit board.

3. The light emitting diode lighting assembly of claim 1 wherein the adhesive material is a double sided foam tape.

4. The light emitting diode lighting assembly of claim 1 wherein the lens includes at least one optical element corresponding to one of said at least one light emitting diode and the circumferential ledge extending from the perimeter of the lens, wherein said flexible housing is molded around the molded polymer section and the lens at the circumferential ledge.

5. The light emitting diode lighting assembly of claim 4 wherein the lens includes pillow optical elements on said inner surface and a protruding optical element on said outer surface.

6. The light emitting diode lighting assembly of claim 5 wherein the protruding optical element is positioned in the center of the outer surface to direct light from said at least one light emitting diode to angles of about 85 to 90 degrees with respect to the optical axis of the light emitting diode.

7. The light emitting diode lighting assembly of claim 1 wherein each extension wing of said pair of extension wings has a low profile in relation to said lens and extends outward from opposing ends of said flexible molded housing.

8. The light emitting diode lighting assembly of claim 1 wherein said molded polymer section further includes an encasing portion for containing wires extending from said circuit board and said flexible molded housing further includes a plug for covering said encasing portion of said molded polymer section, wherein said plug includes circumferential grooves formed therein and is adapted to fit within an opening in a mounting surface.

9. The light emitting diode lighting assembly of claim 1, wherein the circuit board further includes a resistor electrically coupled thereto, said resistor being covered by said molded polymer section.

10. A light emitting diode lighting assembly mountable to a curved surface via a flexible molded housing comprising:

at least one light emitting diode;

a circuit board for providing electrical current to said at least one light emitting diode;

a molded polymer section surrounding and insulating said at least one light emitting diode against said circuit board, wherein said molded polymer section is polyamide;

a lens having an inner surface, an outer surface, and a lens cavity formed therein, said lens being positioned over said molded polymer section such that an air gap is present between a top surface of said at least one light emitting diode and said inner surface of the lens;

said flexible molded housing surrounding a perimeter of said lens and said circuit board thereby sealing said lens and said circuit board, while maintaining the air gap between said top surface of said at least one light emitting diode and said inner surface of the lens, said flexible molded housing having a pair of flexible extension wings, each extension wing of said pair of flexible extension wings having a low profile in relation to said lens and extending outward from opposing ends of said flexible molded housing, wherein said flexible molded housing is polyamide; and an adhesive material positioned against a back portion of said flexible molded housing for attaching said light emitting diode lighting assembly to said curved surface; and wherein said pair of flexible extension wings are elastically deformable wherein the flexible molded housing includes a pair of flexible extension wings elastically deformable up to a radios of curvature of 4.5 inches such that said light emitting diode lighting assembly may be adhesively attached to said curved surface.

11. The light emitting diode lighting assembly of claim 10 further comprising a second molded polymer section for sealing a bottom surface of said circuit board.

12. The light emitting diode lighting assembly of claim 10 wherein the adhesive material is a double sided foam tape.

13. The light emitting diode lighting assembly of claim 10 wherein the lens includes at least one optical element corresponding to one of said at least one light emitting diode and a circumferential ledge extending from the perimeter of the lens, wherein said flexible housing is molded around the molded polymer section and the lens at the circumferential ledge.

14. The light emitting diode lighting assembly of claim 13 wherein the lens includes pillow optical elements on said inner surface and a protruding optical element on said outer surface.

15. The light emitting diode lighting assembly of claim 14 wherein the protruding optical element is positioned in the center of the outer surface to direct light from said at least one light emitting diode to angles of about 85 to 90 degrees with respect to the optical axis of the light emitting diode.

16. The light emitting diode lighting assembly of claim 10 wherein said molded polymer section further includes an encasing portion for containing wires extending from said circuit board and said flexible molded housing further includes a plug for covering said encasing portion of said molded polymer section, wherein said plug includes circumferential grooves formed therein and is adapted to fit within an opening in a mounting surface.

* * * * *